United States Patent [19]

Guillou et al.

[11] Patent Number: 4,778,963

[45] Date of Patent: Oct. 18, 1988

[54] TWO-THRESHOLD CHANGEOVER PRESSURE SWITCH

[75] Inventors: Yves Guillou, Villemonble; Christian Baux, Levallois Perret, both of France

[73] Assignee: Jaeger, France

[21] Appl. No.: 37,645

[22] Filed: Apr. 13, 1987

[30] Foreign Application Priority Data

Apr. 15, 1986 [FR] France ..... 86 05376

[51] Int. Cl.[4] ..... H01H 35/34

[52] U.S. Cl. ..... 200/275; 200/83 N

[58] Field of Search ..... 200/275, 83 R, 83 A, 200/83 B, 83 WM, 83 P, 83 L, 83 N, 83 J, 82 R, 159 R, 81.4

[56] References Cited

U.S. PATENT DOCUMENTS

| | | | |
|---|---|---|---|
| 3,064,094 | 11/1962 | Marchi | 200/83 WM |
| 3,127,586 | 3/1964 | Heyn et al. | 200/83 N |
| 3,524,031 | 8/1970 | Mack | 200/83 N |
| 4,006,083 | 2/1977 | Westervelt et al. | 200/83 N X |
| 4,049,935 | 9/1977 | Gruber | 200/83 A X |
| 4,160,139 | 7/1979 | Johnston | 200/83 N |
| 4,214,137 | 7/1980 | Hartley | 200/83 J X |
| 4,255,630 | 3/1981 | Hire et al. | 200/81.4 |
| 4,343,974 | 8/1982 | Hire et al. | 200/243 |
| 4,593,166 | 6/1986 | Hirota et al. | 200/83 J |
| 4,647,739 | 3/1987 | Boulet | 200/81.4 |

FOREIGN PATENT DOCUMENTS

| | | | |
|---|---|---|---|
| 2107788 | 5/1972 | France . | |
| 2513313 | 3/1983 | France | 200/83 J |
| 2521341 | 8/1983 | France . | |
| 1304085 | 1/1973 | United Kingdom . | |
| 1440756 | 6/1976 | United Kingdom . | |

*Primary Examiner*—Henry J. Recla
*Assistant Examiner*—Ernest G. Cusick

[57] ABSTRACT

The invention relates to a pressure switch comprising an insulating housing fitted with contact tabs and receiving moving contact members, a conductive washer, and a membrane subjected to pressure. The pressure switch includes two moving insulating members (15, 19), two contact members (16, 20), two associated springs (17, 21), and a pusher (14) which is conductive and in contact with the membrane. The fixed conductive washer (11) has a central hole through which a cylindrical projection provided on one of the insulating moving members (15) passes, with a rod on the pusher (14) sliding inside said cylindrical projection so that the insulating moving members (15, 19), the contact members (16, 20), and the associated springs (17, 21) are all disposed on the same side of the fixed conductive washer which therefore constitutes one end of the cavity (9) in the insulating housing. The invention is applicable to monitoring and providing warnings concerning pressure variations going beyond one or other of two predetermined thresholds, and in particular to monitoring hydraulic circuits in vehicles provided for lubrication or for braking purposes. These thresholds may respectively indicate that the pressure is too low or too high.

9 Claims, 2 Drawing Sheets

TWO-THRESHOLD CHANGEOVER PRESSURE SWITCH

The present invention relates to a pressure switch of the kind used for monitoring a working pressure in which variations beyond a predetermined threshold need to be indicated, and more particularly the present invention relates to a changeover pressure switch having two thresholds.

BACKGROUND OF THE INVENTION

Such devices can be used, for example, to detect when a pressure becomes too low, as in the case of the oil pressure in the oil pump of a motor vehicle, or else to detect when a pressure becomes too high, as in an enclosure containing gas under high pressure. A warning signal is then essential to avoid the dangerous consequences that ensue from such pressure variations beyond given predetermined thresholds.

The state of the art in general is illustrated in U.S. Pat. No. 3,064,094, British Patent No. 1 304 085, and in French Patent No. 2 521 341. The following patents may also be mentioned: British Patent No. 1 440 756, U.S. Pat. No. 3,121,145, and French Patent No. 2 107 788.

Most of these prior devices include only one moving contact member, whereas in some applications it is advantageous to have two thresholds available, for example a first threshold which constitutes an early warning and a second threshold which is an alarm indicating that immediate action must be taken, which generally means that a machine must be switched off.

The present invention relates to a development of such a two-threshold device, and in particular of a two-threshold changeover pressure switch.

The term "changeover" is used in the present specification to indicate that a low pressure circuit is on when the device is subjected to a low extreme pressure, that a high pressure circuit is on when the device is subjected to a high extreme pressure, and that neither circuit is on when the device is subjected to an in-between pressure. This is in contrast to a device in which both circuits would be on at one extreme pressure, in which only one of the circuits would be on in the middle range, and in which both circuits would be off at the opposite extreme.

Such two-threshold changeover pressure switches already exist, and a typical example is described in French Patent No. 2 513 313. The device shown in this prior French patent comprises an insulating housing including contact tabs and having a cavity receiving a moving insulating member supporting a first contact member, a fixed conductive washer, and an insulating pusher passing through said washer, said pusher supporting a second contact member and coming into abutment against a membrane whose opposite face is subjected to the action of a pressure, said cavity further including resiliently deformable means tending to maintain the contact members against their supports, said contact members co-operating with said conductive washer to open and close corresponding electric circuits including corresponding ones of said contact tabs, said circuits being opened and closed as a function of the value of the pressure acting on the membrane relative to predetermined threshold pressures.

The structure of this device is complicated, in particular concerning the fixed conductive washer which is drum-shaped, having a bottom with a plurality of openings therethrough, and also concerning the associated three-rod contact member. The component parts are disposed on either side of the bottom of the drum, thereby complicating structure ad operation. In addition, reliability and accuracy suffer from the complexity of the structure. In addition to the risk of the telescopic parts jamming against each other, there is a risk of the contact disposed between the bottom of the moving insulating member and the bottom of the fixed conductive drum being crushed in the event of a sudden surge in pressure (hammering). Finally, the working section of the membrane varies during operation (pusher, then pusher plus moving member), and this requires a suitably strong spring to be provided, to the detriment of accuracy. However, in automobile manufacture in particular, it is advantageous to have monitoring and/or warning devices, e.g. for the hydraulic circuits used for lubrication or for braking, which are reliable, accurate, and competitively priced.

Preferred implementations of the present invention provide a two-threshold changover pressure switch for use in monitoring an/or providing warnings relating to abnormal pressure variations, with the switch being simple in structure, and being reliable and accurate in the long term.

Preferred embodiments of the invention also provide a pressure switch which stands up well to sudden pressure surges in the event that excess pressures are monitored.

Preferred embodiments of the invention provide a pressure switch capable of providing an immediate replacement for an existing device, without requiring complicated disassembly.

SUMMARY OF THE INVENTION

The present invention provides a two-threshold changeover pressure switch comprising an insulating housing having a plurality of contact tabs and including a cavity which receives: at least one insulating moving member supporting a plurality of contact members; a fixed conducting washer; a pusher passing through said said washer; a membrane having one face in contact with said pusher and having its opposite face subjected to the action of a pressure; and resiliently deformable means biasing the contact members against their supports, said contact members co-operating with said conductive washer in order to open or close corresponding electric circuits including respective ones of said contact tabs and as a function of the value of the pressure acting on the membrane relative to two predetermined threshold values; the pressure switch including the improvements of: a first insulating moving member having a first one of said contact members pressed against a bottom portion thereof by the action of a first spring constituting part of said resiliently deformable means, and having a central hole which is extended towards said membrane by means of a cylindrical projection; and a second insulating moving member telescopically received inside said first insulating moving member and having a second one of said contact members pressed against a bottom portion thereof by a second spring constituting a part of said resiliently deformable means, said second contact member having at least one finger passing through said bottom portions of both insulating moving members in order to be able to make contact with said fixed conductive washer; said pusher having a free end which is conductive and which is slidably received in said cylindrical projection; and said fixed conductive washer having a central hole through which said cylindrical projection passes and which acts as one end of the cavity in the insulating housing, such that the insulating moving members, the contact members, and the associated springs are all located on the same side of said conductive washer.

In particular, the first insulating moving member may have lugs projecting from its bottom to provide telescopic guidance for the second insulating moving member, and the first contact member may have an internal cutout through which said guidance lugs pass, thereby enabling said first contact member to be generally flat in shape; the lugs preferably have sloping outer faces suitable for co-operating with a peripheal rim on the first insulating moving member in order to center the associated spring.

Advantageously the second insulating moving member has at least one longitudinal inside slot corresponding to each of the fingers of the second contact member, said slots being formed in a central bore which receives the associated spring.

The pusher may be made entirely of conductive material; however the pusher may alternatively be a composite member, in which case it has a conductive portion at the rear of its disk fixed to the membrane, and also on a portion adjacent to its free end, whereas the remaining portion of said free end is insulating and serves to center the second insulating moving member and the second contact member, thorugh both of which it passes; in particular, the conductive portion of the free end of the pusher is a metal sleeve coming into abutment against a central tab of the first contact member while the remaining insulating portion of said free end passes through an associated opening in said central tab. It would then be possible, for example, to make the first contact member in the form of a flat washer having three successive peripheral cutouts, or else in the form of radial cutouts.

Operation is further improved if projections are provided on the fixed conductive washer to serve as contact abutments against the conductive face of the disk on the pusher.

BRIEF DESCRIPTION OF THE DRAWINGS

An embodiment of the invention is described by way of example with reference to the accompanying drawings, in which.

MORE DETAILED DESCRIPTION

Figure 1:
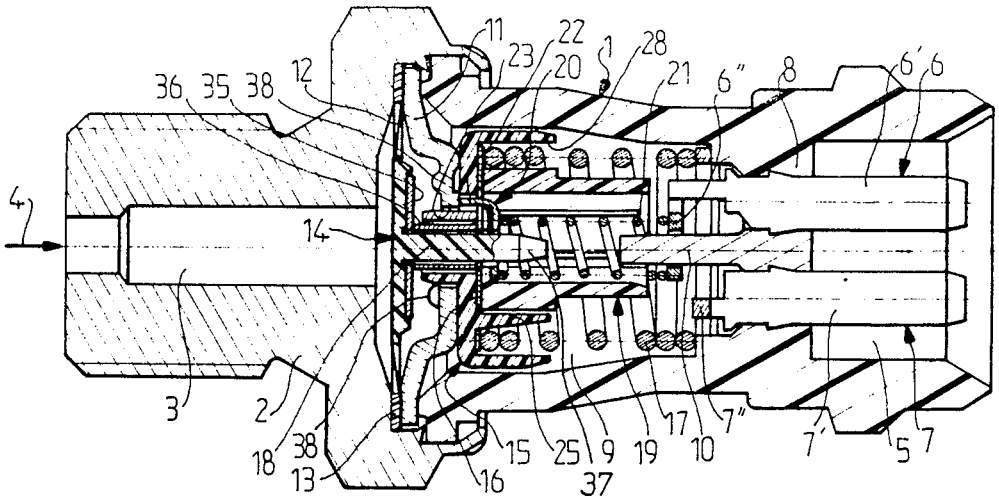
FIG. 1 is an axial section through a pressure switch in accordance with the invention, showing its moving components in a position which corresponds to a pressure below its low threshold, and suitable for detecting increases of pressure therefrom.

The pressure switch shown comprises an insulating housing 1 for fixing, preferably by crimping, to a metal body 2 having a central bore 3 constituting a pressure-tapping orifice for a liquid such as oil whose working pressure is represented by arrow 4. The metal body 2 has a threaded cylindrical shank and a hexagonal head.

At its end furthest from the body 2, the insulating housing 1 is conventionally provided with an open recess 5 having two male spade contact tabs 6 and 7 projecting therein and suitable for receiving complementary female spade connectors in order to make respective connections to the low pressure signal (low threshold) and to the high pressure signal (high threshold). The tabs 6 and 7 pass through an end wall 8 of the housing 1. On the outside of the end wall 8, the tabs constitute conventional male spade connectors 6' and 7' for external connection, and on the inside of the end wall 8, the tabs have respective internal portions 6'' and 7'' received in a cavity 9 of the housing 1 which also receives the moving contact members of the pressure switch.

Figure 2:
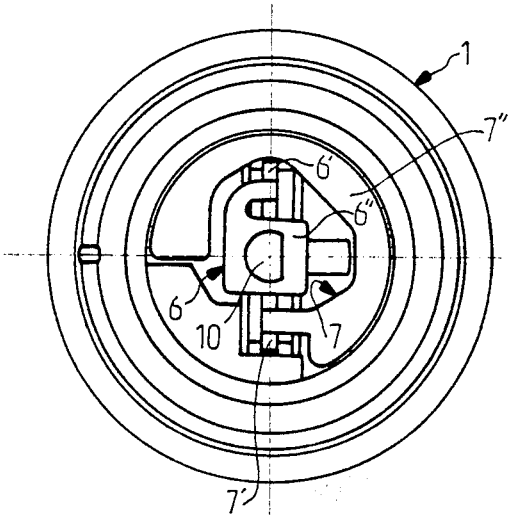
FIG. 2 is an end view showing the inside of the housing of the FIG. 1 pressure switch fitted with its two contact tabs.

FIG. 2 shows the special shapes of the internal portions 6'' and 7'' of the tabs 6 and 7 more clearly. In this figure, it can be seen that the internal portion 6'' is threaded over a central peg 10 projecting inwardly from the end wall 8, with said portion 6'' being surrounded on three-fourths of its periphery by the internal portion 7'' of the tab 7, said portion 7'' being supported on a shoulder formed inside the housing which in turn provides a support surface to an end portion of the spring 17.

At the other end of the housing 1, a conductive washer 11 supports a membrane 12 whose periphery is clamped between one of the edges of the washer 11 and a sealing ring 13, with the assembly being held in place by the crimping which fixes the insulating housing 1 onto the metal body 2, said crimping ensuring that the assembly as a whole is leak-proof. One face of the membrane 12 is thus subjected to the working pressure, whereas the other face is in contact with an axially-movable pusher 14 for responding to changes in the working pressure. The conductive washer 11 is in electrical contact with the metal body 2 and is somewhat saucer-shaped, thereby supporting the membrane 12 without pinching it, regardless of the position of the pusher 14 relative to the bottom of the saucer-shaped washer 11.

In accordance with the invention, the pressure switch includes a first insulating moving member 15 having a first contact member 16 held against the bottom thereof by a first spring 17, and having a central hole which extends towards the membrane 12 in the form of a cylindrical projection 18. The pressure switch also includes a second insulating moving member 19 which is telescopically received in the first insulating moving member 15 and which has a second contact member 20 pressed against the bottom thereof by a second spring 21. Said second contact member has at least one finger 22 passing through the bottoms of both insulating moving members 15 and 19 in order to make contact with the fixed conducting washer 11. In addition, the pusher 14 whose free end slides inside the cylindrical projection 18 is conductive, and the fixed conductive washer 11 has a central hole 23 through which said cylindrical projection passes, with the washer 11 serving as an end plate for the cavity 9 in the insulating housing 1.

A fundamental consequence of the structure of a pressure switch in accordance with the invention lies in the fact that the insulating moving members 15 and 19, the contact members 16 and 20, and the associated springs 17 and 21 are all disposed on the same side of the conductive washer 11, threreby providing numerous practical advantages, including simplicity in structure and connection.

The plan views of FIGS. 3 to 6 respectively show the first insulating moving member 15, the first contact member 16, the second insulating moving member 19, and the second contact member 20 in the order in which they are assembled, thus facilitating comprehension of the structure of these items as shown in the assembled position in FIG. 1.

Figure 3:
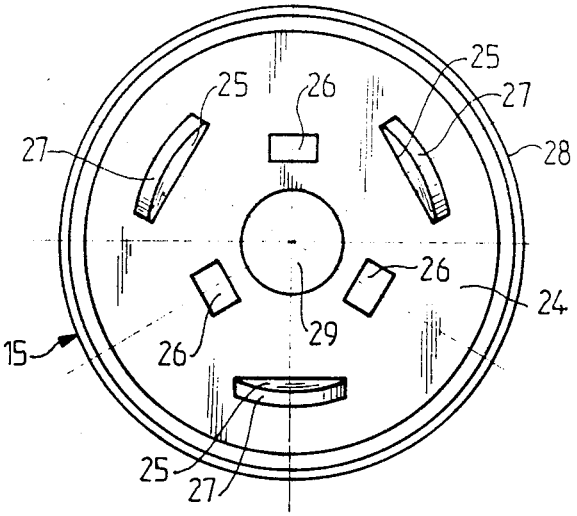
FIG. 3 is an end view of the first insulating member used in the present invention.

The first isolating moving member 15 shown in FIG. 3 is generally dish-shaped with a bottom 24 having three lugs 25 for telescopically guiding the second insulating moving member 19, and also having three openings 26 for passing the fingers 22 of the second contact member 20. It will be understood that the numbers of lugs and openings could be other than three. The lugs 25 have substantially conical rear surfaces 27 for centering the first spring 17 in co-operation with a peripheral rim 28 surrounding the bottom 24 of the insulating moving member. The central hole 29 is extended beyond the other side of the bottom 24 by the cylindrical projection 18 shown in FIG. 1. This insulating moving member 15 may be made of injected plastic material, for example, and is preferably made from glass-impregnated 6—6 polyamide so as to have adequate strength to withstand the spring force when hot.

Figure 4:
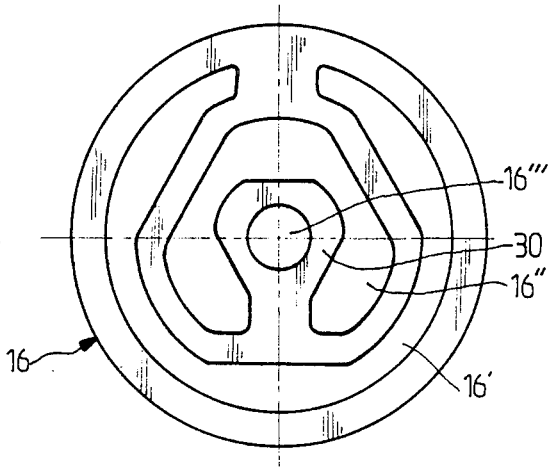
FIG. 4 is an end view of the first contact member used in the present invention.

FIG. 4 shows an advantageous shape for the first contact member 16. This contact member is provided in the form of an essentially flat washer having three successive peripheral cutouts 16', 16'', and 16''' providing highly satisfactory operating reliability. The first cutout 16' allows the guide lugs 25 of the first insulating moving member 15 to pass therethrough, while the second cutout 16'' defines a central tab 30 which is thus highly flexible in the axial direction, and said central tab 30 is itself pierced by the third cutout 16''' in order to allow the free end of the pusher 14 to pass therethrough. This advantageous structure gives the contact member particularly satisfactory performance, and the axial flexibility obtained serves to minimize any interference with the characteristics of the resilient membrane 12.

Figure 5:
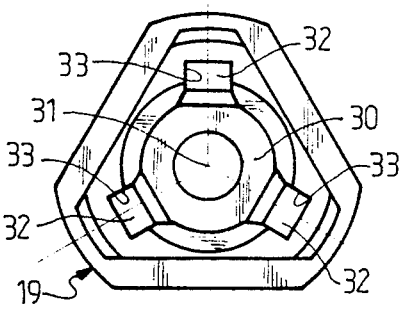
FIG. 5 is an end view of the second insulating member and the second contact member used in the present invention.
Figure 6:
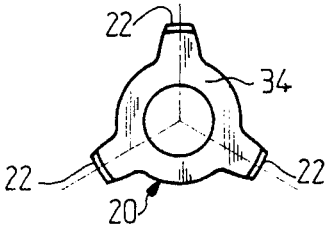
FIG. 6 is an end view of the second contact member used in the present invention.

In FIG. 5, the second insulating moving member 19 is shown in the form of a drum having a bottom 30' with a central hole 31 through which the free end of the pusher 14 passes, together with three openings 32 at 120° intervals, each of which extends a longitudinal groove 33 running along the entire length of the insulating moving member. This structure serves to hold and guide the second contact member 20 whose shape is shown in FIG. 6. The second contact member 20 has three contact fingers 22 projecting radially outwardly from a ring 34 and folded substantially perpendicularly to the plane of said ring to pass through the above-mentioned openings 32 in the second insulating moving member 19 while said contact member 20 is guided by the associated grooves 33 as it is displaced relative to the insulating member 19 against the associated spring 21. The insulating moving member 19 is advantageously made of injected plastic material, e.g. of the same material as is used for the first insulating moving member 15.

As mentioned above, and in accordance with an essential characteristic of the invention, the pusher 14 is cnoductive so as to allow electricity to pass between the fixed conductive washer 11 and the first contact member 16 through the first insulating moving member 15, in a manner described below. Naturally, several different constructions are possible: the pusher may be made entirely of metal, e.g. silver-plated copper, and its free end could come into abutment against the central portion of the first contact member, to pass current when its disk comes into abutment against the fixed conductive washer (in which case the bottom 30' of the second moving member 19 does not have the central hole 31 as shown in FIG. 5); alternatively the pusher 14 could be made of insulating material with special contact zones thereof being coated in conductive material, as shown in FIG. 1. Thus, there is a flat washer 35 on the inside face of the pusher disk, and a metal sleeve 36 which is adjacent to said first conductive portion 16 and which covers a portion only of the free end 37 of the pusher. The remaining portion of said free end is insulating and can therefore pass through the bottom of the second insulating moving member 19 and the ring of the second contact member 20 in order to provide a guidance function, without interfering with the conductive portions it meets.

It should also be observed that there are three projections 38 at 120° intervals on the fixed conductive washer 11 serving as contact-making abutments for the conductive face 35 of the disk of the pusher 14.

As is made clear in the following description of the operation of a pressure switch in accordance with the invention, the two connection circuits (i.e. one for the high pressure signal and the other for the low pressure signal) are opened or closed depending on the respective positions of the following component parts: for the low pressure signal the closed connection circuit passes successively through the fixed conductive washer 11, the second contact member 20, the associated spring 21, and the contact tab 6; whereas for the high pressure signal the closed connection circuit passes successively through the conductive fixed washer 11, the conductive pusher 14 (and in particular its conductive portions 35 and 36), the first contact member 16, the associated spring 17, and the contact tab 7.

The position shown in FIG. 1 is a rest position which the pressure switch occupies in the absence of any pressure. In this position, the high pressure connection circuit is open, while the low pressure connection circuit is closed, given that the second contact member 20 is in abutment via its fingers 22 against the fixed conductive washer 11 by virtue of the spring 21 associated therewith. When nominal pressure is applied (arrow 4), the pusher 14 is moved and slides in the cylindrical projection 18 of the first insulating moving member 15. As a result, the sleeve 36 which is mounted along with the pusher 14 moves the second insulating moving member 19 by contacting the circumferential portion of the tab 30 of the contact member 16. Once contact with the tab 30 is made, the axial biasing force imparted to tab 30 translates to the outer concentric ring portions of the member 16 to thereby contact the bottom of insulating member 19 and then moves the fingers 22 of the contact member 20 away from the fixed conductive washer 11, thereby opening the associated low pressure signal connection circuit. As a result, once the first pressure threshold to be detected has been reached, both connection circuits are open.

If the pressure increases further, the pusher disk comes into contact with the end edge of the cylindrical projection 18, thereby moving the first insulating moving member 15 against the associated spring 17, and finally sets up contact between the conductive portion of the disk 35 on the pusher and the projections 38 on the fixed contact washer 11. The connection circuit corresponding to the low pressure signal naturally remains open; however, the circuit associated with the high pressure signal is now closed by virtue of the contact between the pusher and the fixed conductive washer, and the pressure has therefore reached the second detection threshold.

It should be observed that a sudden increase in pressure corresponding to a value which reaches or even exceeds the second threshold gives rise to properly distributed pressure between the conductive pusher and the fixed conductive washer, without any risk of damaging any of the contact members. This resistance to damage due to hammering constitutes an advantage of a pressure switch in accordance with the invention compared with prior art pressure switches, and in particular compared with the switch described in French Patent No. 2 513 313.

Respective indicator lamps are advantageously provided to indicate when the high and low pressure connection circuits are closed.

The sensitivity of the pressure switch and also the range of pressures over which it operates are determined by the design of the springs (rated force, length) and by the axial stroke between abutments. The thresholds are therefore predetermined by construction in each case. However, additional adjustment may be provided by acting on the accessible portions of the tabs 6 and 7, i.e. by changing the positions of their associated contact portions 6″ and 7″.

The above description of pressure switch operation is given in terms of an increasing pressure. Naturally, the pressure switch is also capable of functioning in conjunction with a decreasing pressure. If a fall of pressure is of interest rather than a rise in pressure, then the position in which the pusher is in abutment against the fixed conducting washer becomes the nominal pressure position. As pressure falls, the conductor pusher leaves its abutment position against the fixed conducting washer, thereby passing the first threshold, and if pressure falls further still, the contact fingers of the second contact member come, in turn, into contact with said conductive washer, thereby crossing the second threshold and arriving in the position shown in FIG. 1.

The invention is not limited to the embodiment described, but covers any variant falling within the scope of the claims. For example, the electrical and mechanical functions provided by the springs could be separated by providing additional contact means. The contact tabs and/or the contact members could be of various different shapes depending on the intended applications and on the intended type of switching (in particular the first contact member may have radial cutouts in order to avoid any risk of creep in its ring under the effect of the associated spring).

We claim:

1. A two-threshold changeover pressure switch comprising an insulating housing having a plurality of contact tabs each respectively connected with a corresponding electric circuit and including a cavity having an end which receives:

at least one insulating moving member supporting a plurality of contact members;

a fixed conducting washer;

a pusher passing through said said washer;

a membrane having one face in contact with said pusher and having its opposite face subjected to the action of a pressure; and resiliently deformable means biasing the plurality of contact members against said at least one insulating moving member, said plurality of contact members co-operating with said conductive washer in order to open or close the respective corresponding electric circuits as a function of the value of the pressure acting on the membrane relative to two predetermined threshold values;

the pressure switch including the improvements of:

a first of said at least one insulating moving members having a first one of said plurality of contact members pressed against a bottom portion thereof by the action of said resiliently deformable means, and having a central hole which is extended towards said membrane by means of a cylindrical projection, said resiliently deformable means pressing said first one of said plurality of contact members being comprised of a first spring member; and a second of said at least one insulating moving members telescopically received inside said first of said at least one insulating moving members and having a second one of said plurality of contact members pressed against a bottom portion thereof by said resiliently deformable means, said second one of said plurality of contact members having at least one finger passing through said bottom portions of both insulating moving members in order to be able to make contact with said fixed conductive washer, said resiliently deformable means pressing said second one of said plurality of contact members being comprised of a second spring member;

said pusher having a free end and a free end portion which is conductive and which is slidably received in said cylindrical projection; and said fixed conductive washer having a central hole receiving said cylindrical projection and wherein said fixed conductive washer acts as the end of the cavity in the insulating housing, such that the insulating moving members, the plurality of contact members, and the associated first and second spring members are all located on the same side of said conductive washer.

2. A pressure switch according to claim 1, wherein the first of said at least one insulation moving members has lugs projecting from the bottom portion thereof to provide telescopic guidance for the second of said at least one insulating moving members.

3. A pressure switch according to claim 2, wherein the first one of said plurality of contact members has an internal cutout through which said lugs pass, thereby enabling said first one of said plurality of contact members to be generally flat in shape.

4. A pressure switch according to claim 2, wherein the first of said at least one insulating moving members has a peripheral rim thereon and the lugs have sloping outer faces suitabe for co-operating with a peipheral rim on the first of said at least one insulating moving members in order to center the first spring member.

5. A pressure switch according to claim 1, wherein the second of said at least one insulating moving members has at least one longitudinal inside slot corresponding to the at least one finger of the second one of said plurality of contact members, said at least one longitudinal inside slot being formed in a central bore which receives the second spring member.

6. A pressure switch according to claim 1, wherein the pusher having a face adjacent said fixed conductive washer has a conductive portion located on said face adjacent said fixed conductive washer and said free end portion which is conductive is located adjacent to said free end leaving on the free end, a nonconductive portion, whereby the nonconductive portion of said free end mounts and centers the second of said at least one insulating moving members and the second one of said plurality of contact members.

7. A pressure switch according to claim 6, wherein the first of said plurality of contact members includes a central tab having an opening formed therein and the pusher free end portion which is conductive is a metal sleeve coming into abutment against said central tab of the first of said plurality of contact members while the pusher nonconductive portion of said free end passes through said opening in said central tab.

8. A pressure switch according to claim 7, wherein the first of said plurality of contact members is in the form of a flat washer having three successive peripheral cutouts defining said central tab portion.

9. A pressure switch according to claim 6, wherein projections are provided on the fixed conductive washer to serve as contact abutments against the conductive portion face of the pusher located on the side adjacent said fixed conductive washer.

* * * * *